US007874442B2

(12) United States Patent
Nievierowski et al.

(10) Patent No.: US 7,874,442 B2
(45) Date of Patent: Jan. 25, 2011

(54) HOT-FILL PLASTIC CONTAINER WITH RIBS AND GRIP

(75) Inventors: John A. Nievierowski, Ann Arbor, MI (US); Michael T. Lane, Brooklyn, MI (US); Christopher LaBombarbe, Ypsilanti, MI (US)

(73) Assignee: AMCOR LImited, Abbotsford (AU)

( * ) Notice: Subject to any disclaimer, the term of this patent is extended or adjusted under 35 U.S.C. 154(b) by 1056 days.

(21) Appl. No.: 11/545,034

(22) Filed: Oct. 6, 2006

(65) Prior Publication Data

US 2008/0083696 A1 Apr. 10, 2008

(51) Int. Cl.
*B65D 23/10* (2006.01)
*B65D 1/42* (2006.01)

(52) U.S. Cl. ..... 215/384; 215/382; 215/398; 220/669; 220/673; 220/675

(58) Field of Classification Search ..... 215/382, 215/384, 398, 379, 381, 383; 220/673, 771, 220/772, 669, 675
See application file for complete search history.

(56) References Cited

U.S. PATENT DOCUMENTS

| | | | | |
|---|---|---|---|---|
| 5,141,120 | A | 8/1992 | Brown et al. | |
| 5,141,121 | A | 8/1992 | Brown et al. | |
| 5,472,105 | A * | 12/1995 | Krishnakumar et al. | 215/384 |
| 5,598,941 | A | 2/1997 | Semersky et al. | |
| 5,971,184 | A | 10/1999 | Krishnakumar et al. | |
| 6,161,713 | A * | 12/2000 | Krich | 215/384 |
| 6,164,474 | A | 12/2000 | Cheng et al. | |
| 6,223,920 | B1 | 5/2001 | Lane et al. | |
| 6,264,053 | B1 | 7/2001 | Slat | |
| 6,277,321 | B1 * | 8/2001 | Vailliencourt et al. | 264/529 |
| 6,349,839 | B1 | 2/2002 | Mooney | |
| 6,375,025 | B1 | 4/2002 | Mooney | |
| 6,390,316 | B1 | 5/2002 | Mooney | |
| 6,398,052 | B1 | 6/2002 | Cheng et al. | |
| 6,439,413 | B1 | 8/2002 | Prevot et al. | |
| 6,467,639 | B2 * | 10/2002 | Mooney | 215/384 |
| 6,581,794 | B2 * | 6/2003 | Boukobza | 215/383 |
| 6,698,606 | B2 | 3/2004 | Deubel et al. | |
| 6,749,075 | B2 | 6/2004 | Bourque et al. | |
| 6,796,450 | B2 | 9/2004 | Prevot et al. | |
| 7,080,746 | B2 | 7/2006 | Saito et al. | |
| 7,080,748 | B2 * | 7/2006 | Sasaki et al. | 215/384 |
| 7,097,061 | B2 * | 8/2006 | Simpson et al. | 215/396 |
| 7,165,693 | B2 * | 1/2007 | Oguchi et al. | 215/381 |
| 7,296,703 | B2 * | 11/2007 | Lane | 215/384 |
| 2003/0042222 | A1 * | 3/2003 | Wurster et al. | 215/379 |
| 2006/0108317 | A1 * | 5/2006 | Tanaka et al. | 215/382 |
| 2006/0175284 | A1 | 8/2006 | Noll et al. | |
| 2006/0186083 | A1 * | 8/2006 | Joshi et al. | 215/381 |
| 2007/0039918 | A1 * | 2/2007 | Lane et al. | 215/381 |

* cited by examiner

*Primary Examiner*—Sue A Weaver
(74) *Attorney, Agent, or Firm*—Harness, Dickey & Pierce, P.L.C.

(57) ABSTRACT

A plastic container including an upper end having an aperture defining an opening of the container. A lower end defines a base of the container. A sidewall portion merges into a grip portion and extends between the upper end and the lower end. The sidewall portion and the grip portion each include a plurality of horizontal ribs. The horizontal ribs of the sidewall portion each include at least one chamfered rib that provides additional structural strength and support to the container during hot fill, packaging and shipping operations.

7 Claims, 2 Drawing Sheets

HOT-FILL PLASTIC CONTAINER WITH RIBS AND GRIP

FIELD

The present teachings relate to a container for storing a commodity such as a liquid.

BACKGROUND

The statements in this section merely provide background information related to the present disclosure and may not constitute prior art.

As a result of environmental and other concerns, plastic containers such as polyethylene terephthalate (PET) containers are being used to package numerous commodities previously supplied in glass containers. PET containers are lightweight, inexpensive, recyclable and manufacturable in large quantities. PET containers, however, may be susceptible to distortion since they are continually being re-designed in an effort to reduce the amount of plastic required to make the container. While this strategy realizes a savings with respect to material costs, the reduction in the amount of plastic may decrease container rigidity and structural integrity.

Container rigidity and structural integrity is particularly important when these containers are filled using a hot-fill process. A hot-fill process is when a liquid product at an elevated temperature, typically between 155° F.-205° F. (68° C.-96° C.) and usually at approximately 185° F. (85° C.), is inserted into the container. When packaged in this manner, the hot temperature of the liquid commodity sterilizes the container at the time of filling.

After being hot-filled, the containers are capped and allowed to reside at generally the filling temperature for approximately five minutes at which point the container, along with the product, is then actively cooled prior to transferring to labeling, packaging, and shipping operations. The cooling reduces the volume of the liquid in the container. This product shrinkage phenomenon results in the creation of a vacuum within the container. If not controlled or otherwise accommodated, these vacuum pressures result in deformation of the container, which leads to either an aesthetically unacceptable container or one that is unstable. Hot-fillable plastic containers, therefore, should provide sufficient flexure to compensate for the changes of pressure and temperature, while maintaining structural integrity and aesthetic appearance. Typically, the industry accommodates vacuum related pressures with sidewall structures or vacuum panels. Such vacuum panels generally distort inwardly under vacuum pressures in a controlled manner to eliminate undesirable deformation.

Thus, there is a need for an improved lightweight container which can accommodate the vacuum pressures which result from hot filling, prevent container sidewall sag, while still providing a more rigid and structurally sound container that can withstand the rigors of packaging, shipping, and being handled by a consumer.

SUMMARY

The present teachings provide a plastic container including an upper end having an aperture defining an opening of the container. A lower end defines a base of the container. A sidewall portion merges into a grip portion and extends between the upper end and the lower end. The sidewall portion and the grip portion each include a plurality of horizontal ribs. The horizontal ribs of the sidewall portion each include at least one chamfered rib that provides additional structural strength and support during hot fill, packaging and shipping operations.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

DETAILED DESCRIPTION

Figure 1:
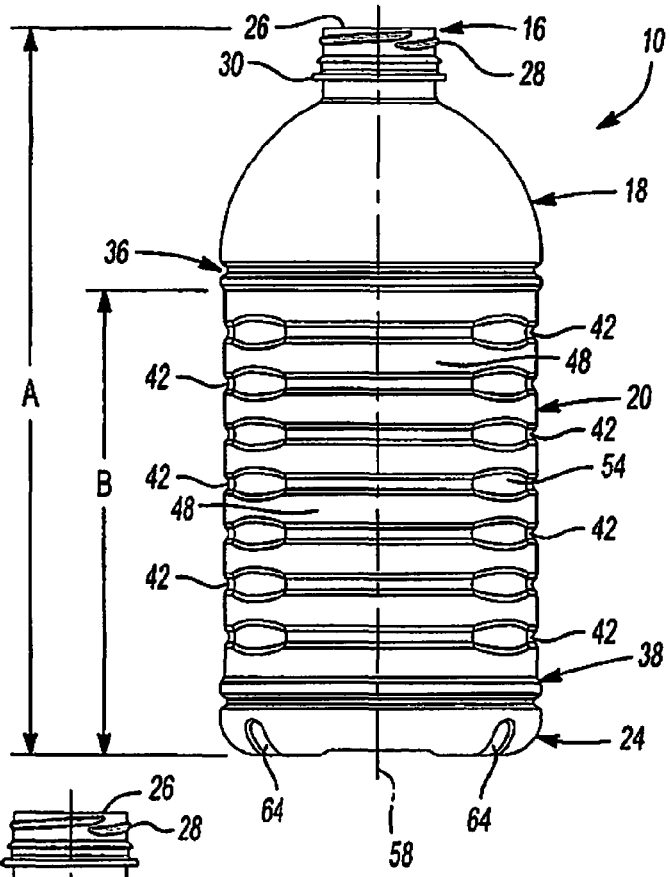
FIG. 1 is a front perspective view of a container according to the present teachings.

The following description is merely exemplary in nature and is not intended to limit the present disclosure, application, or uses. It should be understood that throughout the drawings, corresponding reference numerals indicate like or corresponding parts and features.

FIGS. 1-5 show a configuration of a hot-fill container 10 according to the present teachings. The container 10 is a plastic, e.g. polyethylene terephthalate (PET), hot-fillable container. As shown in FIG. 1, the container 10 has an overall height A, and a sidewall and base portion height B. The overall height A is selected so that the container 10 fits on the shelves of a supermarket or store. In the illustrated example, the overall height A is about 11.345 inches (288.18 mm), and the sidewall and base portion height B is about 6.00 inches (152.4 mm).

Figure 4:
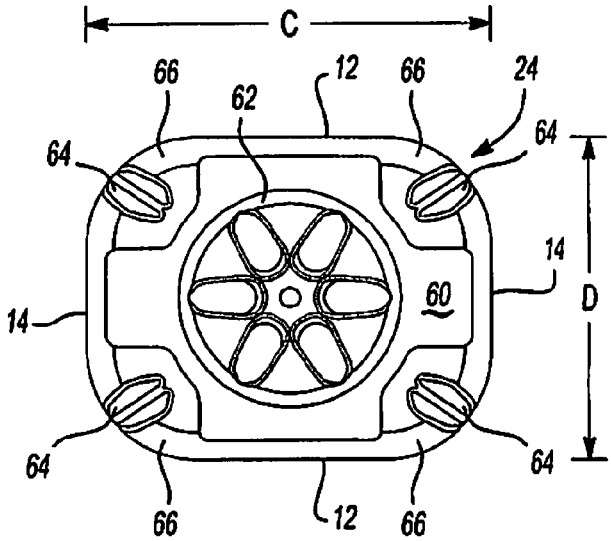
FIG. 4 is a bottom perspective view of the container according to the present teachings.

As shown in FIG. 4, the container 10 is substantially rectangular in cross sectional shape including opposing longer sides 12 each having a width C, and opposing shorter, parting line sides 14 each having a width D. In the illustrated example, the width C is about 6.259 inches (155.88 mm), and the width D is about 4.972 inches (126.29 mm). The widths C and/or D are selected so that the container 10 can fit within the door shelf of a refrigerator.

Opposing longer sides 12 are oriented at approximately 90 degree angles to the shorter, parting line sides 14 so as to form a generally rectangular cross section as shown in FIG. 4. In this particular configuration, the container 10 has a volume capacity of about 128 fl. oz. (3785 cc). One of ordinary skill in the art, however, will acknowledge and appreciate that the present teachings are applicable to other containers, such as round or square shaped containers, which may have different dimensions and volume capacities. It is also contemplated that other modifications can be made depending on the specific application and environmental requirements.

Figure 2A:
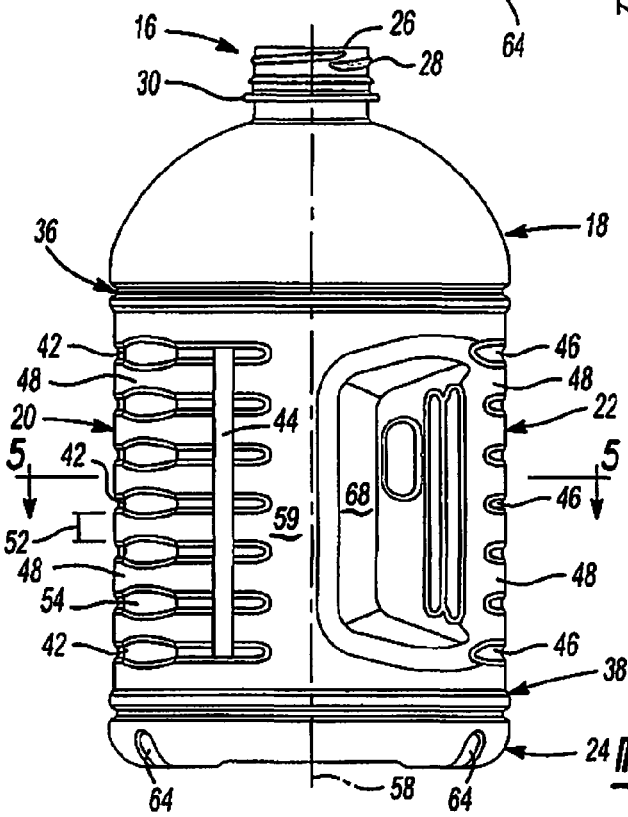
FIG. 2A is a side perspective view of the container according to the present teachings.
Figure 2B:
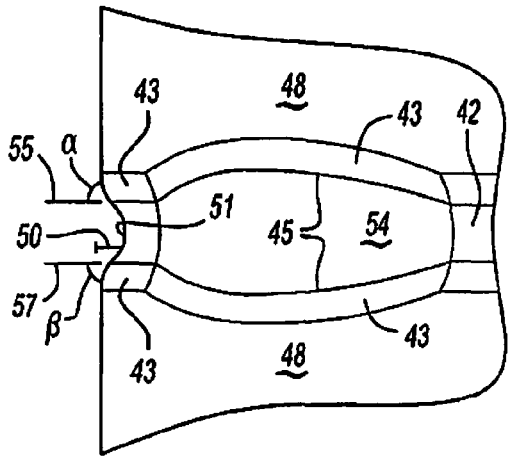
FIG. 2B is a close-up view of a horizontal and chamfered rib according to the present teachings.
Figure 3:
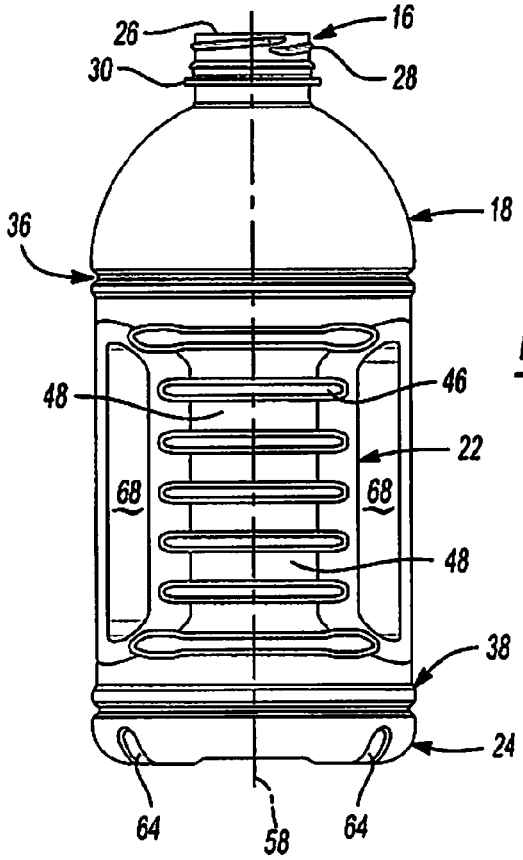
FIG. 3 is rear perspective view of the container according to the present teachings.

As shown in FIGS. 1-3, the container 10 of the invention includes a finish 16, a shoulder region 18, a sidewall portion 20, a grip portion 22, and a base 24. The container 10 is designed to retain a commodity during a thermal process, typically a hot-fill process. In addition, the container 10 may be suitable for other high-temperature pasteurization or retort filling processes, or other thermal processes as well.

The container 10 of the present teachings is a blow molded, biaxially oriented container with a unitary construction from a single or multi-layer material. A well-known stretch-molding, heat-setting process for making the container 10 generally involves the manufacture of a preform (not illustrated) of a polyester material, such as polyethylene terephthalate (PET). A machine (not illustrated) places the preform heated to a temperature between approximately 190° F. to 250° F. (approximately 88° C. to 121° C.) into a mold cavity (not illustrated) having a shape similar to the container 10. The mold cavity is heated to a temperature between approximately 250° F. to 350° F. (approximately 121° C. to 177° C.). A stretch rod apparatus (not illustrated) stretches or extends the heated preform within the mold cavity to a length approximately that of the container thereby molecularly orienting the polyester material in an axial direction generally corresponding with a central longitudinal axis 58 of the container 10.

While the stretch rod extends the preform, air having a pressure between 300 PSI to 600 PSI (2.07 MPa to 4.14 MPa) assists in extending the preform in the axial direction and in expanding the preform in a circumferential or hoop direction thereby substantially conforming the polyester material to the shape of the mold cavity and further molecularly orienting the polyester material in a direction generally perpendicular to the axial direction, thus establishing the biaxial molecular orientation of the polyester material in most of the container. Typically, material within the finish 16 and a sub-portion of the base 24 are not substantially molecularly oriented. The pressurized air holds the mostly biaxial molecularly oriented polyester material against the mold cavity for a period of approximately two to five seconds before removal of the container from the mold cavity.

Alternatively, other manufacturing methods using other conventional materials including, for example, polyethylene naphthalate (PEN), a PET/PEN blend or copolymer, and various multilayer structures may be suitable for the manufacture of the container 10. Those having ordinary skill in the art will readily know and understand plastic container manufacturing method alternatives.

The finish 16 of the container 10 includes a portion defining an aperture or mouth 26, a threaded region 28, and a support ring 30. The aperture 26 allows the container 10 to receive a commodity while the threaded region 28 enables attachment of a similarly threaded closure or cap (not illustrated). Accordingly, the closure or cap (not illustrated) engages the finish 16 to hermetically seal the container 10. The support ring 30 may be used to carry or orient the preform (the precursor to the container 10) (not illustrated) at various stages of manufacture. For example, the preform may be carried by the support ring 30, the support ring 30 may be used to aid in positioning the preform in the mold, or an end consumer may use the support ring 30 to carry the container 10 once manufactured.

Integrally formed with the finish 16 and extending downward therefrom is the shoulder region 18. The shoulder region 18 merges into and provides a transition between the finish 16 and the sidewall portion 20. The sidewall portion 20 extends downward from the shoulder region 18 to the base 24. The construction of the sidewall portion 20 of the container 10 (described below) allows the sidewall portion 20 to provide increased rigidity and structural support to the container 10. The base 24 functions to close off the bottom portion of the container 10 and, together with the finish 16, the shoulder region 18, and the sidewall portion 20, to retain the commodity.

As illustrated in FIGS. 1-3, and briefly mentioned above, the sidewall portion 20 merges into and is unitarily connected to the shoulder region 18 and the base 24. The sidewall portion 20 includes an upper stiffening rib 36 defining a transition between the shoulder region 18 and the sidewall portion 20, and a lower stiffening rib 38 defining a transition between the base 24 and the sidewall portion 20. The above-mentioned transitions may be abrupt in order to maximize the localized strength as well as form a geometrically rigid structure. The resulting localized strength increases the resistance to creasing, buckling, denting, bowing and sagging of the sidewall portion 20 when the container 10 is exposed to outside forces such as top load and drop forces.

The sidewall portion 20 includes a series of horizontal ribs 42. Horizontal ribs 42 extend continuously in a longitudinal direction about the sidewall portion 20 and merge with or slightly intersect vertically extending ribs 44 that are disposed adjacent the grip portion 22. The grip portion 22 also includes horizontal ribs 46 that have the same shape and cross-section as horizontal ribs 42. Defined between each adjacent horizontal rib 42 and 46 are lands 48. Lands 48 provide additional structural support and rigidity to the sidewall portion 20 and the grip portion 22 of the container 10. It should be understood that although only a single vertically extending rib 44 is illustrated on each of opposing longer sides 12 of the container 10, a series of vertical ribs 44 having varying lengths may be used. Vertical ribs 44 serve to prevent unwanted movement of shorter, parting line sides 14 which may otherwise be caused by positive or negative pressures within the container. Vertical ribs 44 act as a hinge, providing an isolating effect. As such, vertical ribs 44 act to distribute vacuum pressures evenly across generally flat surface 59 and keep such pressures away from the grip portion 22 and a front label area of the container 10. Thereby, vertical ribs 44 isolate the grip portion 22 and the front label area of the container 10 from resultant vacuum pressures.

Horizontal ribs 42 and 46 have an overall depth dimension 50 measured between a lower most point 51 and lands 48. The overall depth dimension 50 ranges approximately from about 0.039 inches (1.0 mm) to about 0.118 inches (3.0 mm). Preferably, the overall depth dimension 50 is approximately 0.059 inches (1.5 mm). Regardless, the overall depth dimension 50 of the ribs 42 and 46 should be approximately half of a width dimension 52 of the lands 48 that separate adjacent ribs 42 and 46. As illustrated in the figures, the overall depth dimension 50 and the width dimension 52 are fairly consistent among all of the horizontal ribs 42 and 46. However, in alternate embodiments, it is contemplated that the overall depth dimension 50 and the width dimension 52 of horizontal ribs 42 and 46 may vary between opposing sides or all sides of the container 10, thus forming a series of modulating horizontal ribs.

As best shown in FIGS. 2A and 2B and in accordance with the present teachings, horizontal ribs 42 include, at various points along a length of the horizontal ribs 42 in the longitudinal direction, chamfered ribs 54. In the illustrated configurations shown in FIGS. 1, 2A, and 2B, chamfered ribs 54 are generally oblong shaped ribs that are formed on front rounded corners 56 of the sidewall portion 20 (see FIG. 5). The oblong shaped chamfered ribs 54, in combination with one another, located on each front rounded corner 56 of the container 10 provide four vertical support columns. These four vertical support columns allow the container 10 to withstand greater top load forces than current commercially available containers having greater weight. While oblong shaped chamfered ribs 54 are illustrated as being formed on front rounded corners 56, it is contemplated that they could also be formed on rear rounded corners of the sidewall portion 20 as well.

As such, oblong shaped chamfered ribs 54, along with vertical ribs 44, assist in providing additional strength during the hot fill process, as well as increased structural support for the container 10. In addition, chamfered ribs 54 assist in isolating movement of the sidewall portion 20 by reducing bulging during filling of the container 10 with a commodity, and improve rigidity of the sidewall portion 20 by providing a stiffer, more reliable surface during labeling of the container 10. Chamfered ribs 54 also provide greater impact strength that protects the container 10 during packaging and shipping. As such, these resultant localized strengths allow the container 10 to better control fill weight distribution and container expansion than current commercially available containers while being significantly lighter in weight.

Horizontal ribs 42 and chamfered ribs 54 are defined by angled sidewalls 43. Angled sidewalls 43 are preferably angled with respect to an upper horizontal plane 55 and a lower horizontal plane 57. In one example, angle $\alpha$, measured relative to an upper horizontal plane 55, may be measured in the range of approximately 5° to approximately 85°. Similarly, angle $\beta$, measured relative to a lower horizontal plane 57, may be measured in the range of approximately 5° to approximately 85°. Accordingly, the present teachings contemplate that opposing angled sidewalls 43 may have the same or different angle measurements.

At the point of the horizontal ribs 42 where chamfered ribs 54 are formed, the angled sidewalls 43 undergo a radius of curvature 45 in the axial direction that gives the chamfered ribs 54 their oblong-shape. The depth of the chamfered ribs 54 is preferably not greater than 65% of the width of the lands 48 that separate adjacent chamfered ribs 54. Notwithstanding, it should be understood that the depth of the chamfered ribs 54 may vary throughout the sidewall portion 20. Further, although the chamfered ribs 54 are shown to be aligned in substantially linear alignment along front rounded corners 56 of the sidewall portion 20, the present teachings should not be limited to such a configuration. That is, it should be understood that the chamfered ribs 54 may be staggered at various points along horizontal ribs 42. Chamfered ribs 54 also should not be limited to disposition at front rounded corners 56 of the sidewall portion 20. In contrast, chamfered ribs 54 may be disposed at any position along horizontal ribs 42 without departing from the spirit and scope of the present teachings.

While the above-described configuration of horizontal ribs 42 including chamfered ribs 54 is illustrated in the various figures, a person of ordinary skill in the art will readily understand that other geometrical designs and arrangements are feasible. Accordingly, the exact shape, number and orientation of horizontal ribs 42 and chamfered ribs 54 can vary depending on various design criteria. For example, as stated above, chamfered ribs 54 may be staggered in contrast to being linearly vertically aligned. Moreover, each horizontal rib 42 is not required to include a chamfered rib 54. In this regard, alternating horizontal ribs 42 may include chamfered ribs 54.

As is commonly known and understood by container manufacturers skilled in the art, a label may be applied to the sidewall portion 20 using methods that are well known to those skilled in the art, including shrink wrap labeling and adhesive methods. As applied, the label may extend around the entire body or be limited to a portion of the sidewall portion 20. In this regard, the generally flat surface 59 located on each of opposing longer sides 12 between the grip portion 22 and vertical ribs 44 provides a good adhesive surface. As such, the container 10 provides for better label application and protection.

The construction of the sidewall portion 20 provides added structure, support and strength to the sidewall portion 20 of the container 10. This added structure, support and strength enhances the top load and side impact strength capabilities of the container 10 by aiding in transferring top load and side impact forces, thereby preventing creasing, buckling, denting and deforming of the container 10 when subjected to top load and side impact forces. Furthermore, this added structure, support and strength, resulting from the construction of the sidewall portion 20, minimizes the outward movement, bowing and sagging of the sidewall portion 20 during fill, seal and cool down procedure.

Thus, the sidewall portion 20 maintains its relative stiffness throughout the fill, seal and cool down procedure. Accordingly, the distance from the central longitudinal axis 58 of the container 10 to the sidewall portion 20 is fairly consistent throughout the entire longitudinal length of the sidewall portion 20 from the shoulder region 18 to the base 24, and this distance is generally maintained throughout the fill, seal and cool down procedure. Additionally, the lower stiffening rib 38 of the sidewall portion 20 isolates the base 24 from any possible sidewall portion 20 movement and creates structure, thus aiding the base 24 in maintaining its shape after the container 10 is filled, sealed and cooled, increasing stability of the container 10, and minimizing any potential rocking as the container 10 shrinks after initial removal from its mold.

As illustrated in FIG. 4, the base 24 has a generally octagonal shaped contact surface 60, creating a generally octagonal footprint. Within contact surface 60 is a circular push up 62. The contact surface 60 is itself that portion of the base 24 that contacts a support surface that in turn supports the container 10. As such, the contact surface 60 may be a flat surface or a line of contact that generally circumscribes, continuously or intermittently, the base 24. In the configuration illustrated in FIG. 4, the contact surface 60 is a uniform, generally octagonal shaped surface that provides a greater area of contact with the support surface, thus promoting greater container stability. The circular push up 62 is generally centrally located in the base 24.

In the corners of the base 24, between opposing longer sides 12 and opposing shorter, parting line sides 14, may be formed modulating vertical ribs 64. Modulating vertical ribs 64 follow the contour of the base 24, extending vertically continuously almost the entire height of the base 24, between the sidewall portion 20 and the contact surface 60. Modulating vertical ribs 64 are surrounded by lands 66. Thus, the contact surface 60, modulating vertical ribs 64, and lands 66 form a continuous integral base 24 of the container 10.

Further, the construction of contact surface 60 and modulating vertical ribs 64 of the base 24, as well as the geometry of the base 24, adds structure, support and strength to the container 10. This construction and geometry of the base 24 enables the potential use of thicker walls providing better rigidity, lightweighting, manufacturing ease and material consistency. This added structure and support, resulting from this construction and geometry minimizes the outward movement or bowing of the base 24 during the fill, seal and cool down procedure. Thus, the base 24 maintains its relative stiffness throughout the fill, seal, and cool down procedure.

The added structure and strength, resulting from the construction and geometry of the base 24 also aids in the transferring of top load forces, thus aiding in preventing the base 24 from buckling, creasing, denting and deforming. It should be understood, however, that while the above-described geometry and features of the base 24 may be preferred, a person of ordinary skill in the art will readily acknowledge and appreciate that other geometrical designs and arrangements are feasible. Accordingly, the exact shape and orientation of features of the base 24 can vary greatly depending on various design criteria.

Figure 5:
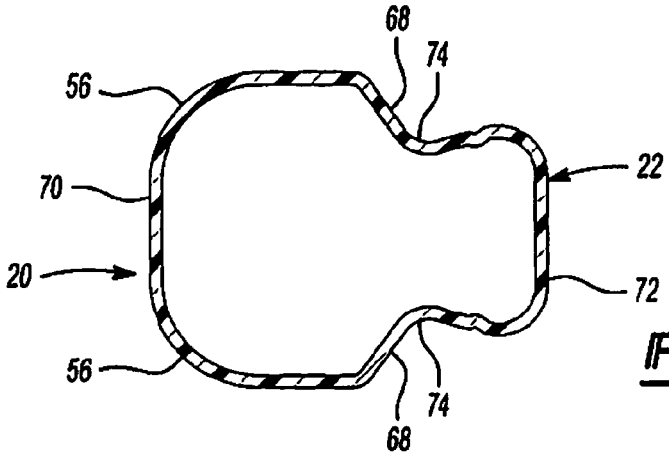
FIG. 5 is a cross sectional view along line 5-5 shown in FIG. 2A.

As illustrated in FIGS. 2A, 3, and 5, the grip portion 22 provides a portion of the container 10 for a consumer to grasp and hold the container 10. Sidewall portion 20 merges into grip portion 22 where grip walls 68 are slanted from a front portion 70 of the container 10 towards a rear portion 72 of the container 10. At a lowermost point 74 of the grip walls 68, the grip walls 68 begin to slant outward toward opposing longer sides 12. In this manner, the grip portion 22 includes an ergonomically beneficial configuration that comfortably assists a consumer of varying hand sizes in handling the container 10. In this regard, it is contemplated that the grip portion 22 may be of any pinch grip construction known in the industry. By way of example, including but not limited to, those disclosed in commonly owned U.S. Pat. Nos. 5,141,120, 5,141,121 and 6,223,920, all of which are incorporated herein by reference.

While the above description constitutes the present disclosure, it will be appreciated that the disclosure is susceptible to modification, variation and change without departing from the proper scope and fair meaning of the accompanying claims.

What is claimed is:

1. A plastic container comprising:

an upper portion having a mouth defining an opening into the container, a sidewall portion extending from said upper portion to a base, said base closing off an end of the container; said upper portion, said sidewall portion and said base cooperating to define a receptacle chamber within the container into which product can be filled; said sidewall portion defined in part by a grip portion, a hinge means adjacent said grip portion and a plurality of horizontal ribs; wherein each of said plurality of horizontal ribs include at least one chamfered rib formed therein, said chamfered rib having a chamfered rib width greater than a width of each of said plurality of said horizontal ribs, said hinge means located between said grip portion and said chamfered rib, wherein said grip portion further comprises a pinch grip and said hinge means further comprises a pair of vertical ribs that intersect each of said plurality of horizontal ribs and said at least one chamfered rib further comprises a pair of chamfered ribs.

2. The plastic container of claim 1 wherein each of said pair of chamfered ribs are vertically aligned relative to adjacent chamfered ribs formed in adjacent horizontal ribs, said horizontal ribs arranged in parallel from said base to said upper portion.

3. The plastic container of claim 1 wherein a horizontal cross section of the container is generally rectangular in shape having rounded front corners, and each of said pair of chamfered ribs are formed in said rounded front corners.

4. The plastic container of claim 1 wherein each of said plurality of horizontal ribs and each of said pair of chamfered ribs are defined in part by angled sidewalls.

5. The plastic container of claim 4 wherein said angled sidewalls defining said chamfered ribs include a radius of curvature in an axial direction.

6. A plastic container comprising:

an upper portion having a mouth defining an opening into the container, a shoulder region extending from said upper portion, a sidewall portion extending from said shoulder region to a base, said base closing off an end of the container; said upper portion, said shoulder region, said sidewall portion and said base cooperating to define a receptacle chamber within the container into which product can be filled; the container having a generally rectangular shape in horizontal cross section with rounded front corners; said sidewall portion defined in part by a grip portion, a pair of vertical ribs adjacent said grip portion and a plurality of horizontal ribs; wherein each of said plurality of horizontal ribs include a pair of oblong shaped ribs formed therein, and each of said pair of oblong shaped ribs formed in said rounded front corners of the container, and each of said pair of oblong shaped ribs are approximately parallel to each other and vertically aligned relative to adjacent oblong shaped ribs formed in adjacent horizontal ribs, said each of said plurality of horizontal ribs arranged parallel to each other from approximately said base to approximately said shoulder region, wherein said grip portion further comprises a pinch grip, and each of said pair of vertical ribs intersect each of said plurality of horizontal ribs, said each of said pair of vertical ribs located between said pinch grip and each of said pair of oblong shaped ribs.

7. The plastic container of claim 6 wherein a depth of each of said pair of oblong shaped ribs is less than 65% of a distance measured between adjacent oblong shaped ribs formed in adjacent horizontal ribs.

* * * * *

UNITED STATES PATENT AND TRADEMARK OFFICE

CERTIFICATE OF CORRECTION

PATENT NO. : 7,874,442 B2
APPLICATION NO. : 11/545034
DATED : January 25, 2011
INVENTOR(S) : John A. Nievierowski et al.

It is certified that error appears in the above-identified patent and that said Letters Patent is hereby corrected as shown below:

Title Page, No. (73), Assignee, "AMCOR LImited" should be --AMCOR Limited--.

Signed and Sealed this
Eighth Day of November, 2011

David J. Kappos

David J. Kappos
*Director of the United States Patent and Trademark Office*